United States Patent [19]

Mouri et al.

[11] Patent Number: 4,502,158

[45] Date of Patent: Mar. 5, 1985

[54] SLIP DOWN-FREE SOCKS WITH A GARTER

[76] Inventors: Masami Mouri, 548 Hirao Ooaza Koryo-cho; Fumio Uemura, 271-1 Mitsuyoshi Ooaza Koryo-cho, both of Kitakatsuragi-gun, Nara, Japan

[21] Appl. No.: 439,719

[22] Filed: Nov. 4, 1982

[30] Foreign Application Priority Data

Nov. 11, 1981 [JP] Japan ..... 56-181525

[51] Int. Cl.[3] ..... A41B 11/00

[52] U.S. Cl. ..... 2/240

[58] Field of Search ..... 2/240; 66/178, 178 A, 66/172 E

[56] References Cited

U.S. PATENT DOCUMENTS 719,108 1/1903 Hall ..... 2/240

2,035,469 3/1936 Gaines ..... 2/240

2,129,291 9/1938 Van Voorhlis ..... 2/240

2,228,404 1/1941 Saftlas et al. ..... 2/240

FOREIGN PATENT DOCUMENTS 1177530 1/1970 United Kingdom ..... 2/240

*Primary Examiner*—Ronald Feldbaum

*Attorney, Agent, or Firm*—Wenderoth, Lind & Ponack

[57] ABSTRACT

Slip down-free socks with an elastic garter which is joined partly by stitching to the front upper part of a rib top in such a manner that, when the socks is put on, it suspends the socks. Instead of the elastic garter, slip down-free socks can have a garter portion of net stitch to be interposed between a welt portion and a leg portion of the socks.

3 Claims, 3 Drawing Figures

SLIP DOWN-FREE SOCKS WITH A GARTER

BACKGROUND OF THE INVENTION

This invention relates to socks which is free from slipping down even in hard exercise and hard work.

A conventional socks generally has a welt portion including the so-called rib top. This rib top prevents slipping down of the socks in normal use, but when a conventional sock is worn continuously for many hours or when a wearer performs hard exercise or does hard work, it often slips down. This trouble results from the fact that when a conventional sock is put on, its rib top rests on the part of the leg slightly under the biggest portion of the calf and therefore it slips down during exercise or work. This trouble could be prevented by making the rib top tighter, but an excessively tight rib top, if the sock is worn for many hours, interrupts the circulation of the blood in the leg, causing pain and discomfort.

In view of the above trouble, the present invention intends to provide a sock which fits the leg and is entirely free from slipping down, even if worn for many hours, during hard exercise or during hard work.

BRIEF DESCRIPTION OF THE DRAWINGS

The nature and advantages of the present invention will be understood more clearly from the following description made with reference to the accompanying drawings, in which.

DETAILED DESCRIPTION OF THE PREFERRED EMBODIMENT

Socks according to the present invention is knitted of yarn generally used for socks, such as cotton yarn, synthetic yarn (vinylon, nylon, etc.), woollen yarn, hemp yarn or a blend thereof, by an appropriate knitting process, such as tricot stitching, pile stitching, etc. with the addition of a pattern or dyeing where necessary.

Figure 1:
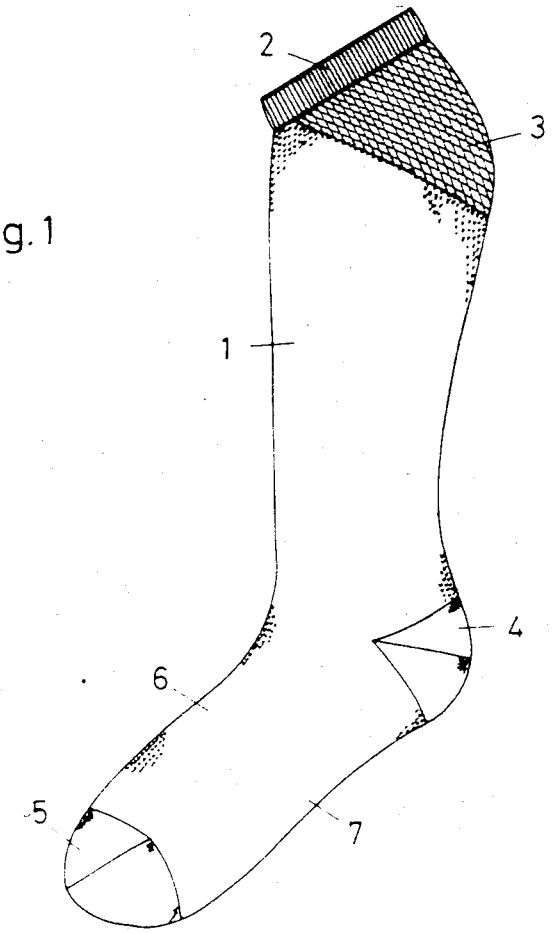
FIG. 1 is a front view of an embodiment of the present invention, showing a garter portion of net stitch joined by stitching to the top part of a leg portion of socks.

Similarly to a conventional sock, a sock according to the present invention comprises a leg portion 1, having a front upper end for covering the shin and a rear upper end for covering the lower end of the calf, an instep 6, a toe 5, a sole 7 and a heel 4. In the case of a conventional sock, a welt portion 2 is connected to the top of the leg portion but in the case of the embodiment of the present invention shown in FIG. 1, only the front part of the welt portion 2 with a rib top is left connected to the leg portion 1 and the remaining part which encircles the wearer's leg above his calf in a front to rear upwardly manner is cut off the leg portion 1 and a garter portion 3 having more elasticity than the leg portion 1 (for example, a garter portion of netting) is joined by stitching to the welt portion 2 and to the leg portion 1, extending over the cut off part. In FIG. 1, the garter portion 3 is shown in nearly triangular shape but is not limited to such shape and can take any shape so far as it covers the calf. The sock is so designed that its welt portion 2 rests on the upper part of the calf, when it is put on.

Figure 2:
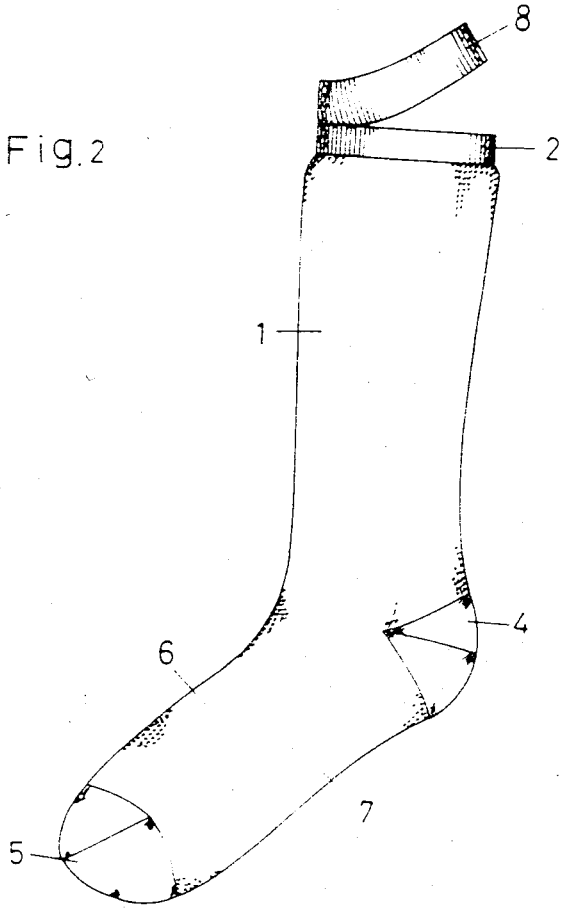
FIG. 2 is a front view of another embodiment of the present invention, showing a garter joined in downward inclination to the top of a welt portion of a sock by stitching.

In the embodiment shown in FIG. 2, the garter portion 3 of netting as shown in FIG. 1 is omitted but instead, the front lower part of a supporter-like elastic garter 8 and the front upper part of the welt portion 2 are joined together by stitching, leaving the remaining parts of both unjoined so that when sock is put on, the unjoined parts are separated and form a triangular space therebetween. In other words, the garter 8 is joined by stitching to the front upper end of the welt portion in a downwardly sloping state. Thus, when the sock according to this embodiment is put on, the welt portion tightens the usual part of the calf and the garter 8 tightens the upper part of the calf, whereby preventing the socks from slipping down.

Figure 3:
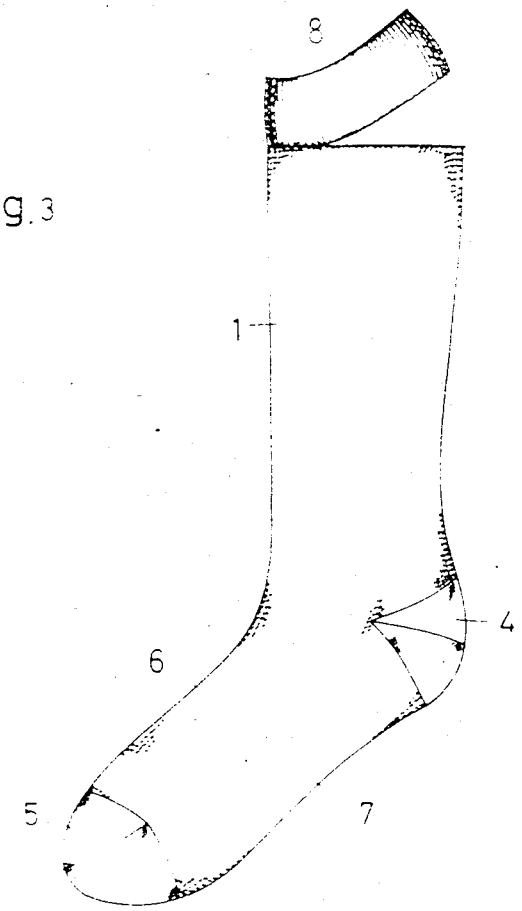
FIG. 3 is a front view of still another embodiment of the present invention, showing a garter portion joined in downward inclination to a welt portion with no rib top by stitching.

The socks shown in FIG. 3 is a modification of the embodiment shown in FIG. 2 and has no rib top. In this case, the garter 8 is held at the position above the calf in such a manner that it suspends sock.

In the sock with a garter manufactured in the above way, the garter is fixed at the position above the calf in such a manner that it suspends sock and therefore even if the force of pulling down the sock is applied to the sock by expansion and contraction between the leg portion and the instep of the sock and at the heel portion during walking or in exercise, slipping down of sock can be prevented by the garter which is fixed to the calf. Thus, the sock according to the present invention is comfortable to wear and free from slipping down even when worn for many hours and during hard exercise and hard work.

What is claimed is:

1. A sock, comprising:

a lower portion for covering at least the foot and ankle of the wearer;

a leg portion above the lower portion having a front upper end and a rear upper end for respectively covering the shin and lower end of the calf of the wearer;

a loop-shaped welt portion connected to said front upper end of said leg portion along an upper front edge of said front upper end so as to encircle the wearer's leg above the calf and hold said sock up; and a garter portion formed of a netting having more elasticity than that of said leg portion, having an upper edge fixed to said welt portion along the entire rear lower edge of said belt portion and having a lower edge fixed to said rear upper end of said leg portion along the entire upper rear edge of said leg portion so as to substantially completely cover the upper portion of the calf of the wearer, whereby the calf of the wear is not exposed.

2. A sock as in claim 1, wherein said welt portion is connected to said front upper end of said leg portion and said upper edge of said garter portion along a lower edge of said garter portion, said lower edge of said garter portion extending upward from opposite ends of said upper front edge of said front upper end of said leg portion, so as to define a triangular opening between said lower edge of said garter portion and said upper rear edge of said leg portion, said garter portion having a triangular shape which completely covers said opening.